United States Patent [19]

Little, Jr.

[11] 4,068,642

[45] Jan. 17, 1978

[54] FUEL RATIO CONTROL WITH MANUALLY OPERATED AIR OVERRIDE

[75] Inventor: Joseph P. Little, Jr., Morton, Ill.

[73] Assignee: Caterpillar Tractor Co., Peoria, Ill.

[21] Appl. No.: 631,964

[22] Filed: Nov. 14, 1975

[51] Int. Cl.[2] ..... F02M 39/02; F02D 1/02

[52] U.S. Cl. ..... 123/140 MP; 123/179 L; 123/140 FG; 123/139 ST

[58] Field of Search ..... 123/140 MP, 140 FG, 123/139 ST, 179 L; 60/601, 603

[56] References Cited

U.S. PATENT DOCUMENTS

| | | | |
|---|---|---|---|
| 2,767,700 | 10/1956 | Parks | 123/140 R |
| 2,867,199 | 1/1959 | Holbrook | 123/140FG |
| 3,077,873 | 2/1963 | Parks et al. | 123/140 MC |
| 3,485,228 | 12/1969 | Updyke et al. | 123/140 MC |
| 3,557,765 | 1/1971 | Mystrom | 123/140 FG |
| 3,795,233 | 3/1974 | Crews et al. | 123/140 MP |
| 3,910,245 | 10/1975 | Okura | 123/140 MP |
| 3,968,779 | 7/1976 | Davis | 123/140 PG |
| 3,981,285 | 9/1976 | Schueler et al. | 123/140 MP |

FOREIGN PATENT DOCUMENTS

| | | | |
|---|---|---|---|
| 865,210 | 12/1960 | United Kingdom | 123/140 MP |

*Primary Examiner*—Charles J. Myhre
*Assistant Examiner*—Parshotani S. Lall
*Attorney, Agent, or Firm*—Phillips, Moore, Weissenberger, Lempio & Majestic

[57] ABSTRACT

An engine fuel-control system having fuel-limiting means for controlling and/or limiting the quantity of fuel delivered to an engine in response to a signal generated by operation of the engine is provided with selectively adjustable overriding means for the fuel-limiting means.

8 Claims, 1 Drawing Figure

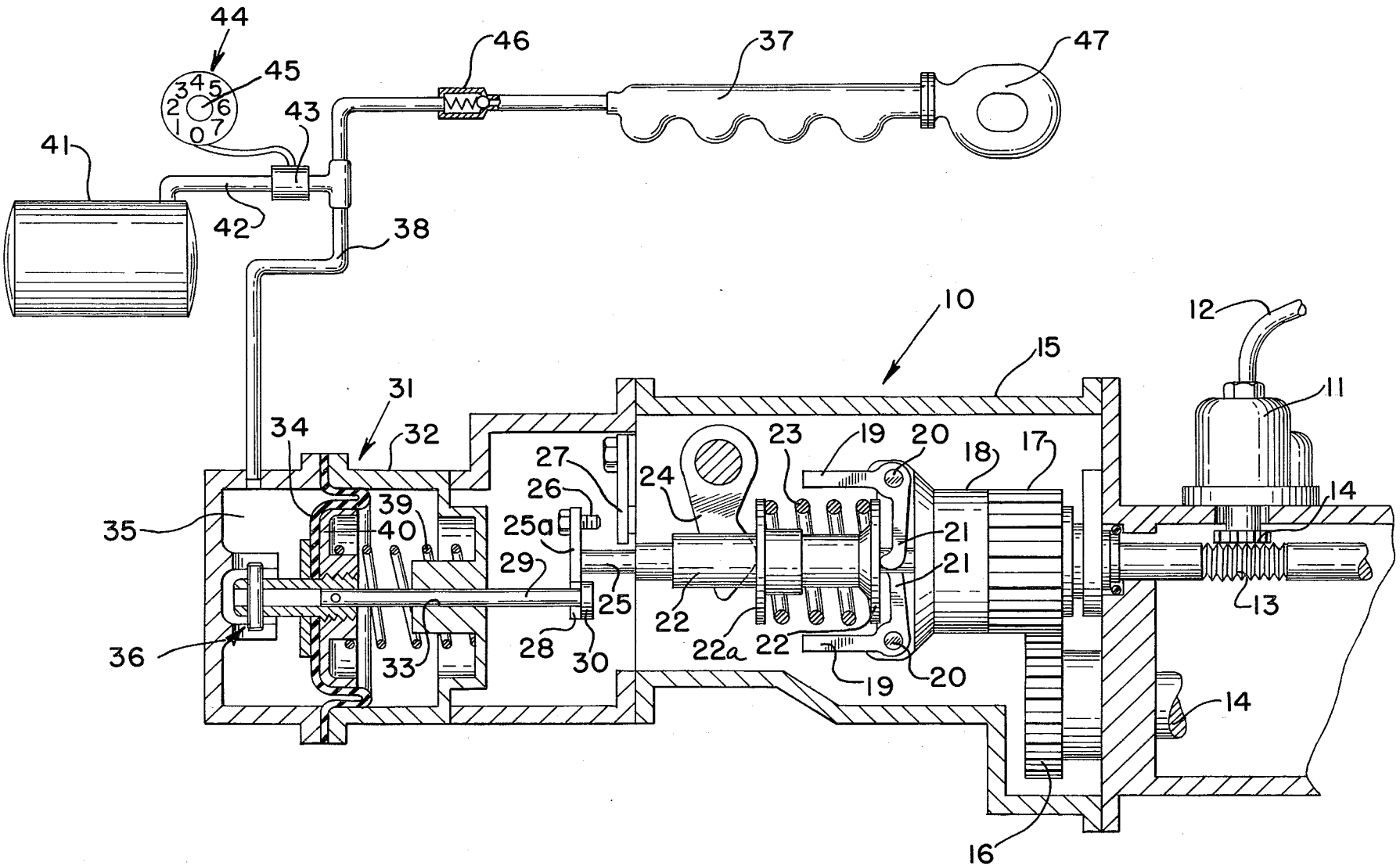
10
11
12
13
14
14
15
16
17
18
19
19
20
20
21
21
22
22
22a
23
24
25
25a
26
27
28
29
30
31
32
33
34
35
36
37
38
39
40
41
42
43
44
45
46
47

FUEL RATIO CONTROL WITH MANUALLY OPERATED AIR OVERRIDE

BACKGROUND OF THE INVENTION

The present invention relates to fuel control systems for internal combustion engines, and relates particularly to governor control means for fuel injection systems.

Many internal combustion engines normally employ governors which are operative in response to the rpm of the engine for controlling the flow of fuel into the combustion chambers of the engine. Such governors are commonly employed on engines having a fuel injection system whether of the sparked-ignition or the compression-ignition type. Such injection systems, however, are more commonly employed or compression-ignition types of engine such as diesel engines.

One problem with such engines is that under rapid acceleration an objectionable amount of exhaust smoke is normally produced. This is especially so of engines which are supercharged by exhaust-driven superchargers. With such engines, a manual governor control can normally be advanced faster than the engine and supercharger can build up to speed to provide sufficient air to the combustion chambers of the engine to support the complete combustion of the fuel being injected therein during a given cycle. The result is that a large quantity of unburned fuel is expelled from the engine and exhausted as exhaust smoke. This results in a waste of fuel as well as possible pollution of the atmosphere.

Another problem with such engines is that they inherently smoke badly under lug conditions. Lug is that condition when resistance to movement of the engine, or engine load, increases until the engine speed is decreased from that indicated by the governor setting. Under such conditions the engine governor attempts to regain the engine's speed by automatically advancing the engine fuel rack to supply more fuel to the engine. However, due to the reduction in supercharger speed as a result of the reduced engine speed, insufficient air is supplied to the engine to support complete combustion of the fuel.

One technique for overcoming this problem has been to provide fuel control means that is responsive to the manifold pressure of the engine to take over under such lug conditions and control the injection. Such systems are shown, for example, in U.S. Pat. No. 2,767,700 issued Oct. 23, 1956 to John H. Parks, and by U.S. Pat. No. 3,485,228 issued Dec. 23, 1969 to K. W. Updyke et al. Both of these patents are assigned to the assignee hereof.

One problem with this type of approach to the fuel injection control is that starting becomes difficult because of the reduced amount of fuel available to the engine. Such reduction in fuel to the engine also inhibits acceleration of the engine. It is desirable from a fuel economy standpoint that a control system be operative to inject the minimum of fuel necessary for complete combustion during the cycle. However, on the other hand, it is necessary under starting conditions to have an excess of fuel in the system available for the combustion chamber in order to start the engine without undue cranking. It is also desirable under certain conditions to be able to accelerate the engine at a reasonable rate.

ASSEMBLY AND OBJECTS OF THE INVENTION

It is a primary object of the present invention to provide means for selectively overriding the fuel-limiting means of the prior art devices.

Another object of the present invention is to provide means for enhancing the acceleration and starting ability of fuel-limited, governor-controlled engines.

Another object of the present invention is to provide simple and inexpensive means for selectively overriding the fuel-limiting means of the fuel systems of prior art engines to provide improved starting ability and acceleration of such engines.

In accordance with the primary aspect of the present invention there is provided means for selectively and ajustably overriding the fuel-limiting means of a fuel control system having a speed-responsive governor. The fuel-limiting overriding means includes a source of pressurized fluid that is operative to selectively override a manifold pressure-responsive fuel-limiting device.

BRIEF DESCRIPTION OF THE DRAWING

The drawing is a schematic layout, partially in section, of a fuel-control system according to the present invention.

DETAILED DESCRIPTION OF THE PREFERRED EMBODIMENT

Referring now to the drawing, there is illustrated a fuel-control system having a governor generally indicated at 10 operatively connected to control a fuel injector 11 which is operative to meter and inject a quantity of fuel by way of a line 12 to either the combustion chamber or the manifold of an engine. An engine normally has an injector for each cylinder, although a single injector is illustrated herein. The injector 11 is controlled as to the amount of fuel it meters by means of a rack 13 which operatively engages a pinion 14 which is rotated by means of longitudinal movement of the rack.

Longitudinal position of the rack 13 is controlled by means of the governor 10 which is driven by means of a shaft 14 from the engine.

The governor comprises a housing 15 rotatably supporting a pinion gear 16 which is mounted on shaft 14 and driven thereby, for meshing with and driving a gear 17 of a flyweight rotor 18. The rotor 18 supports a pair of flyweights 19 which are responsive to centrifugal force upon rotation of the rotor 18 for pivoting in the usual manner about pins 20 and applying pressure by arms 21 against a spring retainer 22 and the rotor 18 to bias the rotor 18 and the rack 13 axially for controlling the metering of the injector 11. A compression spring 23 is compressed between retainer 22 and a retainer **22*a* which is sidably mounted on a sleeve extension of 22. A lever 24 is pivotally mounted in housing 15 and operatively connected by suitable linkage means to a speed controlled lever or pedal which is sometimes referred to as a throttle. The spring 23 is preloaded by means of the lever 24** which is manipulated by a hand lever or foot pedal not shown.

The rack 13 is formed on an elongated shaft or rod 25 which includes at one end stop means comprising a plate or disc member **25*a* secured to the end of the shaft 25 and including a sutable cap screw or the like 26 extending therethrough for abutment with the stop member 27 on housing 15**. This stop position is adjustable and establishes the maximum open position of the fuel injection system.

Further stop means comprises a slot 28 formed in member 25a for receiving a rod member 29 having a head or disc portion 30 defining further adjustable stop means for the governor assembly.

Fuel-limiting means generally indicated at 31 comprises a housing 32 in which is slidably mounted the shaft 29 in a suitable bore 33. The shaft 29 is operatively connected to suitable diaphragm means 34 which is suitably mounted in the housing 32 to define at one end thereof a pressure chamber 35. Suitable guide and support means 33 supports and guides the rod member 29.

The diaphragm 34 constitutes pressure-responsive means which is responsive to manifold pressure established in a manifold 37 of an engine for limiting the quantity of fuel delivered to the engine in response to a signal which comprises the manifold pressure generated by operation of the engine. The manifold pressure generated within the manifold 37 is communicated by conduit means 38 to the chamber 35. A compression spring 39 disposed in housing 32 between one end thereof and a disc member 40 mounted on rod 29 for mounting and supporting the diaphragm 34 is operative to bias the diaphragm 34 to the left and consequently the stop 30 to the minimum fuel position. Thus, movement of rod 29 and rack 13 to the right increases the fuel injected into the engine while movement of the rod and rack to the left decreases the fuel injected into the engine.

Means for overriding this fuel-limiting means comprises an auxiliary source of pressurized fluid which may be from any suitable source but generally indicated here as a tank 41 which is operatively connected by conduit means 42 to supply the pressurized fluid to chamber 35. The communication of the fluid by way of conduit means 42 is controlled by a suitable adjustable pressure-responsive valve 43 which is adjustable by suitable adjusting means 44 which includes suitable indices as indicated in the form of a scale to indicate the relative adjustment thereof. The adjusting means includes suitable means such as a knob 45 which may be rotated to a preselected indicated position.

The auxiliary source of fluid is preferably such as to have a pressure in excess of that normally developed by the manifold pressure from the manifold 37. In such case the overriding means then has the capability of overriding the fuel-limiting means, which has been initially limited by the manifold pressure in the engine, regardless of the manifold pressure. Suitable check valve means 46 is provided in conduit means 38 between the manifold and the juncture of conduit 42 with that of 38 for the purposes of preventing backflow of fluid from the auxiliary source into the manifold 37.

The system is preferably for an engine of the supercharged type having a supercharger 47 which is preferably of the turbocharger type. The turbocharger type of supercharger is driven by means of a turbine from exhaust gases of the engine.

OPERATION

The operator of the engine preselects or selects the governor setting for the engine by means of a control lever or foot pedal which is transmitted to lever 24 which in turn transmits it to rack 13. This sets the preliminary adjustment for the injection cycle. Once the engine starts, this position is altered by means of the governor by the action of the flyweights 19. This alteration is in proportion to the engine speed. It will be noted that the lever 24 acts through spring 23. This spring can be overcome by means of the stop-adjusting means 31. Thus, movement of shaft 29 to the right must also overcome the compression of spring 39. Once the engine starts and pressure builds up in the manifold 37, this pressure is transmitted by way of conduit 38 to chamber 35 and acts on diaphragm 34 to assist the movement to the right of the rod member 29 and thus the stop 30. This permits a higher adjustment in the injection cycle of the engine. This higher adjustment, however, is in direct proportion to pressure available in the chamber 35 and thus permits such increased adjustment in the fuel only when adequate air is available in the manifold 37.

Should the operator of the engine desire to rapidly accelerate the engine from a predetermined rpm, he merely dials the control 44 sufficient to open valve 43 and permit pressure from the source 41 to communicate to chamber 35 and override the position of diaphragm 34 and thus the stop 30.

It should be emphasized that the system is such that the overriding means may be adjusted to its purely zero position and permit the engine to operate under normal conditions.

The overriding means is available under such circumstances as the desire to start the engine, or to accelerate the engine, to override the limiting means and thus increase the fuel available to the engine.

For starting purposes, it will be appreciated that very little pressure will exist in the manifold 37 upon cranking of the engine for starting purposes. However, pressure available from the auxiliary source 41 may be made available to act on the diaphragm 34 to move stop 30 to the right and increase the fuel position of the fuel injection system. Thus the overriding means is available to override the normal fuel-limiting means for either one of starting, or acceleration purposes. It should be appreciated that the overriding means may be set at any predetermined position to override the limiting means at any preselected position. Thus, the overriding means may be made available to accelerate the engine from any position of the governor selectively.

From the above description it is seen that there is provided an improved and simplified overriding means for the fuel-limiting means of an internal combustion engine.

I claim:

1. In an engine fuel-control system having fuel-limiting means for controlling and limiting the quantity of fuel delivered to the engine in response to a signal generated by pressure in a manifold by operation of the engine to an expansible chamber of said system, the improvement comprising means for overriding said fuel-limiting means comprising pressure-responsive means connected to said fuel-limiting means and responsive to pressure variations in said expansible chamber for controlling actuation of said fuel-limiting means;

an auxiliary source of fluid pressure independent of pressure in said manifold; and control means for adjustably directing pressurized fluid from said auxiliary source to said pressure-responsive means so that said pressure-responsive means acts in opposition to and overrides said fuel-limiting means, including adjustable valve means for selectively communicating pressurized fluid from said auxiliary source to said expansible chamber.

2. The engine fuel control system of claim 1 wherein said pressure-responsive means comprises a diaphragm connected to a movable stop member engageable by a fuel rack and defining said fuel-limiting means;

spring means biasing said stop means to a predetermined limiting position; and said pressure signal is communicated to said diaphragm for controlling said quantity of fuel.

3. The engine fuel control system of claim 2 wherein said valve means is operative at preselected pressures to communicate said fluid from said auxiliary source to said diaphragm when said manifold pressure drops below said preselected pressure.

4. The engine fuel control system of claim 1 wherein the fluid pressure in said auxiliary source exceeds the maximum pressure in said manifold.

5. The engine fuel control system of claim 4 wherein said adjustable pressure-responsive valve means includes indicator means to indicate the pressure level at which said valve means is operative.

6. The engine fuel control system of claim 5 wherein said indicator means includes a dial having numerals indicating a pressure operating level of said valve.

7. The engine fuel control system of claim 1 further comprising check valve means interconnected between the manifold of said engine and said auxiliary source of fluid pressure.

8. In an engine fuel-control system having fuel-limiting means for controlling the quantity of fuel delivered to an engine in response to a variable pressure prevalent in a manifold of said engine communicating with an expansible chamber of said system, the improvement comprising means, including an auxiliary source of fluid pressure independent of the pressure in said manifold and connected to said expansible chamber and adjustable valve means for selectively communicating said auxiliary source of fluid pressure with said expansible chamber, for selectively overriding said fuel limiting means in response to communication of said auxiliary source of fluid pressure thereto.

* * * * *